US005643525A

United States Patent [19]

McGinty et al.

[11] Patent Number: 5,643,525

[45] Date of Patent: Jul. 1, 1997

[54] PROCESS FOR IMPROVING ELECTROSTATIC CHARGING OF PLEXIFILAMENTS

[75] Inventors: David Jackson McGinty; Ervin Townsend Powers, Jr., both of Midlothian, Va.; Hyunkook Shin, Wilmington; Roger Keith Siemionko, Hockessin, both of Del.; David Martin Taylor, Gwynedd, United Kingdom

[73] Assignee: E. I. Du Pont de Nemours and Company, Wilmington, Del.

[21] Appl. No.: 218,479

[22] Filed: Mar. 25, 1994

Related U.S. Application Data

[63] Continuation-in-part of Ser. No. 37,562, Mar. 26, 1993, abandoned.

[51] Int. Cl.[6] ..... D01D 5/11

[52] U.S. Cl. ..... 264/469; 264/205; 264/211; 264/211.14

[58] Field of Search ..... 264/13, 22, 24, 264/205, 211, 211.14, 469

[56] References Cited

U.S. PATENT DOCUMENTS

| | | | |
|---|---|---|---|
| 3,081,519 | 3/1963 | Blades et al. | 57/248 |
| 3,169,899 | 2/1965 | Steuber | 428/198 |
| 3,387,326 | 6/1968 | Hollberg et al. | 425/72.2 |
| 3,860,369 | 1/1975 | Brethauer et al. | 425/3 |
| 5,023,025 | 6/1991 | Shin | 264/13 |
| 5,081,177 | 1/1992 | Shin | 524/462 |
| 5,147,586 | 9/1992 | Shin et al. | 264/13 |

*Primary Examiner*—Leo B. Tentoni

[57] ABSTRACT

The efficiency of electrostatic charging of polyolefin web in a process for flash-spinning polyolefin plexifilament from solution in a $C_4$–$C_7$ hydrocarbon, forming the plexifilament into a web, electrostatically charging the web, and laying the web down as a sheet is improved by having present in the electrostatic charging step environment a charge-improving compound, which can be any one of a number of specifically identified classes of charge-improving compounds. The charge improving compounds are present in an amount of at least 0.1 ppm of the atmosphere in that environment or more.

40 Claims, 10 Drawing Sheets

Nitrogen
n-Pentane
0.1 ppm
1 ppm
5 ppm
10 ppm
50 ppm
2.5%
CURRENT
(μamp)
1000
900
800
700
600
500
400
300
200
100
0
0
10
20
30
40
50
60
VOLTAGE
(kV)

PROCESS FOR IMPROVING ELECTROSTATIC CHARGING OF PLEXIFILAMENTS

RELATED PATENT APPLICATIONS

This patent application is a continuation-in-part patent application of commonly owned U.S. patent application Ser. No. 08/037,562 which was filed Mar. 26, 1993, now abandoned.

FIELD OF THE INVENTION

This invention relates to electrostatic charging of flash spun polymer plexifilamentary film-fibril strands which have been spread apart to separate the fibrils, and wherein the electrostatic charging further separates the fibrils and helps to pin the strands down to a moving conveyor.

BACKGROUND OF THE INVENTION

The process of forming plexifilamentary film-fibril strands and forming the same into non-woven sheet material has been disclosed and extensively discussed in U.S. Pat. No. 3,081,519 to Blades et al., U.S. Pat. No. 3,227,794 to R. D. Anderson et al., U.S. Pat. No. 3,169,899 to Steuber, U.S. Pat. No. 3,851,023 to Brethauer et al. and U.S. Pat. No. 3,387,326 to Hollberg et al. This process and various improvements thereof have been practiced for a number of years by E. I. du Pont de Nemours and Company (DuPont) in the manufacture of TYVEK® spunbonded olefin.

Part of the foregoing manufacturing process includes a step of applying an electrostatic charge to a flattened and partially spread open plexifilamentary film-fibril strand after it is spun at a spin pack and before it is laid down on a conveyor belt. The electrostatic charges thereby applied to the individual fibrils cause the fibrils to repel one another, thus separating themselves and further "opening-up" the flattened strand (or probably more accurately described as a plexifilamentary film-fibril web once the strand has been flattened). The "opened-up" web is then suited to being laid down, along with other webs from adjacent spin packs onto a conveyor to form a sheet. The conveyor may also be provided with an electrostatic charge opposite to the charge on the strand thereby causing the webs to be attracted to the conveyor and remain pinned down to the conveyor. The process of applying a charge to the webs has worked quite satisfactorily in the current arrangements, although the equipment for applying the charges continue to require improvements in a number of areas.

In spite of the success and satisfaction with the overall flash spinning process and system, the process includes the use of perchlorofluorocarbon (CFC) solvents which are currently believed to cause ozone depletion and the use of which will soon be legislatively foreclosed. Accordingly, alternative solvents having suitable performance characteristics in the flash-spinning process are being aggressively sought. DuPont has expended considerable resources developing alternative solvents and has focused on several that may eventually be used commercially. As might be expected, the different solvents require some modifications in the manufacturing process or present problems that did not exist using the CFC solvents.

Hydrocarbon solvents are currently considered the most attractive alternatives to the potentially ozone depleting solvents presently in use. However, the resulting hydrocarbon atmosphere, into which the strands are spun, causes a lower charge current efficiency for the electrostatic charge applying equipment. In other words, in the process of manufacturing flash spun polyolefins, the use of promising hydrocarbon solvents reduces the effective electrostatic charge applied to the web passing through the electrostatic field for a given current as compared to the same process using a conventional CFC solvent. As a result, the webs are not as fully opened up and the resulting non-woven sheet is less uniform than a sheet formed of more fully charged webs. Sheet uniformity is an important issue for product quality and has a substantial effect on the value of the product.

Although it would be logical to increase the current to the electrostatic charge applying equipment to thereby increase the charge applied to the web, increasing the amperage to the electrostatic charging system causes excessive deterioration of the current elastomeric target plates in the spin pack. Target plate deterioration would substantially reduce the duration for which the spin pack may be operational in a spin cell. Moreover, even if the deterioration of the target plates may be resolved (such as using a metal target plate), target plates do become fouled with polymer residue during the flash spinning process. The polymer coating reduces the charging efficiency and the electrostatic charging system responds by increasing the charging current to the ion gun to maintain the desired charge on the web. When the target plate is sufficiently fouled so as to require greater charging current than the system is designed to provide, the spin pack must be shut down to be replaced. Replacement of spin packs may require a production shutdown, so average operational life span of a spin pack may seriously effect the economics of production.

Accordingly, it is a primary object of the present invention to provide satisfactory electrostatic web charging performance of a flash spun plexifilamentary film-fibril web at acceptable charge currents and using an environmentally suitable solvent.

More specifically, it is a further object of the present invention to provide an environmentally acceptable solvent that is suited to high pressure dissolving of polyolefins and flash spinning the same wherein an adequate charge can be applied to the produced plexifilamentary film fibril strands so as to be suitable for laying down the webs and forming satisfactory non-woven sheet material on a moving conveyor.

It is a more particular object of the present invention to develop suitable additives for known potential solvents to provide environmentally acceptable solvent/spin liquids for making flash spun plexifilamentary film-fibril webs wherein the vapor from the spin liquid is electrically suitable for adequate charging of the webs so as to be suitable for laying down the webs and forming satisfactory non-woven sheet material on a moving conveyor.

SUMMARY OF THE INVENTION

The above and other objects have been attained by the present invention which is embodied by an improved process for flash-spinning plexifilamentary film-fibril strands of a fiber-forming crystalline polyolefin. The process comprises flash-spinning the plexifilamentary film-fibril strands at a temperature of 130° to 300° C. and at a mixing pressure greater than autogenous pressure from a solution consisting essentially of 8 to 35 weight percent of the polyolefin and 92 to 65 weight percent of a spin liquid. The spin liquid may be a saturated $C_4$–$C_7$ hydrocarbon or a mixture of a saturated $C_4$–$C_7$ hydrocarbon mixed with at least one cosolvent. After the strands are spun, the process includes electrostatically charging the strands and laying the strands as a sheet on a continuously moving surface. The improvement in the process comprises conducting the electrostatic charging step in an atmosphere comprising at least one charge-improving compound, predominantly in gas or vapor form, wherein the charge-improving compound belongs to one of two groups. The first group comprises compounds that have an atmospheric boiling temperature of less than 100° C. and consists of one of carbon dioxide, hydrofluorocarbons, hydrochlorofluorocarbons, perfluorocarbons, $C_1$–$C_4$ alcohols, aliphatic ketones, and polar solvents. The second group consists of compounds not listed in the first group that are within the following categories of compounds: compounds of the types listed in the first group except having atmospheric boiling temperatures of at least 100° C.; halogen gases; acid halides; halocarbons that are not listed in group A; hydroxylic compounds, ethers, carboxylic acids; esters; sulfur compounds; non-aliphatic ketones; aldehydes; nitro compounds; nitrogen oxides; nitriles; ammonia; amines; amides; and any halogenated derivatives of the above compounds which do not already contain a halogen atom. The atmosphere should have least 0.1 ppm of charge-improving compound, up to ten weight percent of the first group of charge-improving compounds, and less than seventy-five weight percent of the second group of charge-improving compounds.

BRIEF DESCRIPTION OF THE DRAWINGS

A more thorough explanation of the invention will be hereinafter provided in which reference will be made to the following drawings.

DETAILED DESCRIPTION OF THE PREFERRED EMBODIMENTS

Figure 1:
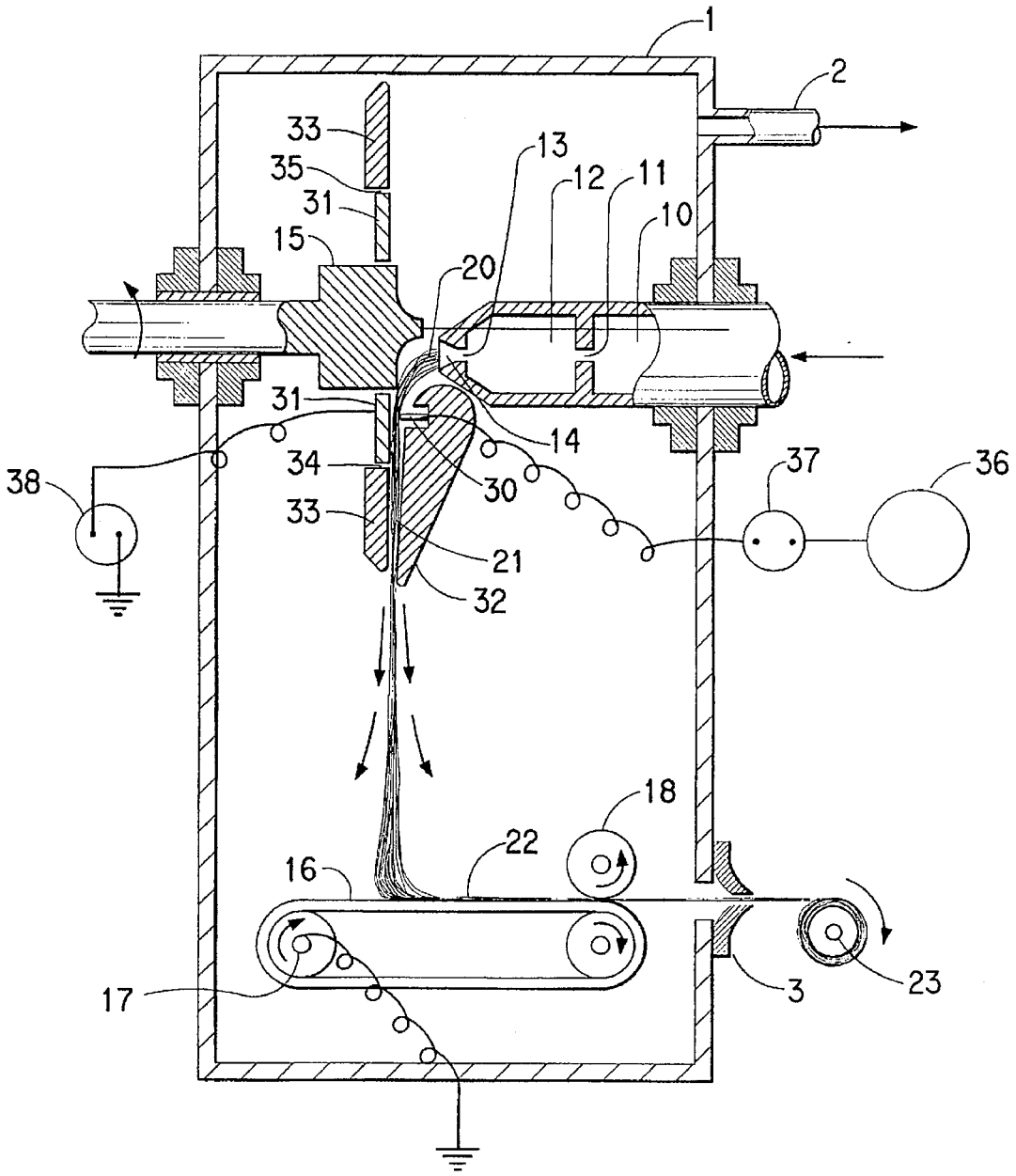
FIG. 1 is a schematic drawing of an apparatus suitable in the process for flash-spinning crystalline polyolefin into a plexifilament film-fibril and laying down the plexifilament web as a sheet on a moving surface, from which it is collected.
Figure 2:
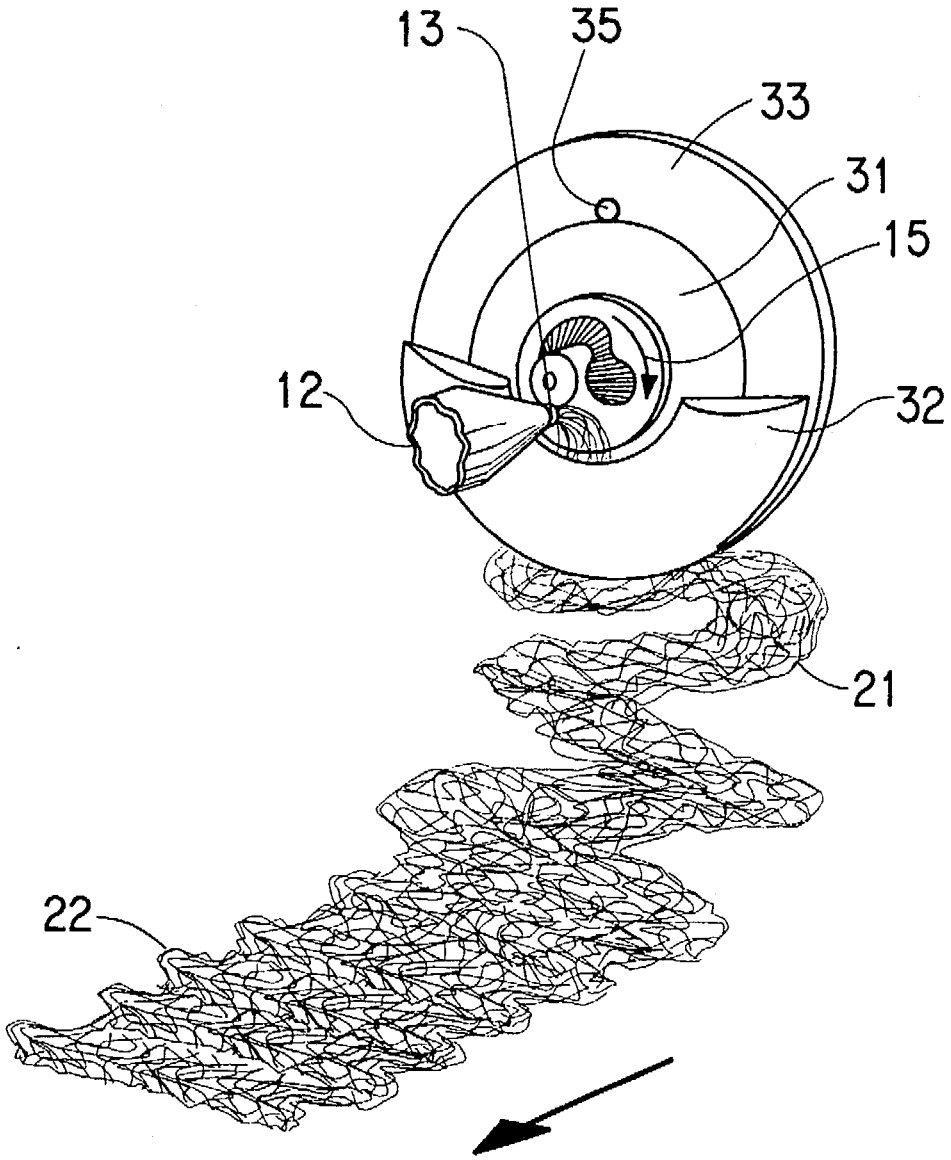
FIG. 2 is a schematic drawing of a rotating baffle arrangement apparatus that can be used in laying down the web.

Referring now to FIGS. 1 and 2, a preferred system and process for flash spinning polyolefin is illustrated. This is a generally well known process and is carried out using standard equipment. Typical polyolefins used in the process are polyethylene and polypropylene. The process is conducted in a chamber 1, sometimes referred to as a spin cell by those in the industry, which has a solvent-removal port 2 and an opening 3 through which non-woven sheet material produced in the process is removed. Polymer solution (or spin liquid) is continuously or batch-wise prepared at an elevated temperature and pressure in a tank 10. The pressure is greater than autogenous pressure, and preferably greater than cloud-point pressure. Autogenous pressure is the equilibrium pressure of the polymer solution in a closed vessel, filled with only solution having both liquid and vapor phases therein, and wherein there are no outside influences or forces. Autogenous pressure is a function of temperature. By providing the solution at greater than autogenous pressure, it is assured that the solution will not have any separate vapor phase present therein. The cloud-point pressure is the lowest pressure at which the polymer is fully dissolved in the solvent forming a homogeneous single phase mixture.

The polymer solution is admitted from the tank 10 through an orifice 11 into a lower pressure (or letdown) chamber 12. In the lower pressure chamber 12, the solution separates into a two-phase liquid-liquid dispersion. One phase of the dispersion is a solvent-rich phase which comprises primarily solvent and the other phase of the dispersion is a polymer-rich phase which contains most of the polymer. This two phase liquid-liquid dispersion is forced through a spinneret 13 into an area of much lower pressure (preferably atmospheric pressure) where the solvent evaporates very rapidly (flashes), and the polyolefin emerges from the spinneret as a yarn (or plexifilament) 20. The yarn 20 is stretched in a tunnel 14 and is directed to impact a rotating baffle 15. The rotating baffle 15 has a shape that transforms the yarn 20 into a flat web 21, which is about 5–15 cm wide, and separating the fibrils to open up the web 21. The rotating baffle 15 further imparts a back and forth oscillating motion having sufficient amplitude to generate a 45–65 cm-wide swath. The web 21 is laid down on a moving wire laydown belt 16 located about 50 cm below the spinneret 13, and as best seen in FIG. 2, the back and forth oscillating motion is arranged to be generally across the belt 16 to form a sheet 22.

As the web 21 is deflected by the baffle 15 on its way to the moving belt 16, it enters a corona charging zone between a stationary multi-needle ion gun 30 and a grounded rotating target plate 31. The multi-needle ion gun 30 is charged to a DC potential of 20–70 kV by a suitable high voltage source 36. The charging current between the high voltage source 36 and the ion gun 30 is measured by a ion gun current microamperemeter 37. Similarly, the discharge current between target plate 31 and the ground is measured by a target plate current microamperemeter 38. The charged web 21 is carried by a high velocity solvent vapor stream through a diffuser consisting of two parts: a front section 32 and a back section 33. The diffuser controls the expansion of the web 21 and slows it down. The back section 33 of the diffuser may be stationary and separate from target plate 31, or it may be integral with it. In the case where the back section 33 and the target plate 31 are integral, they rotate together. FIG. 1 shows the target plate 31 and the back section 33 of the diffuser as a single unit. Aspiration holes 34 and 35 are drilled in the back section 33 of the diffuser to assure adequate flow of gas between the moving web 21 and the diffuser back section 33 to prevent sticking of the moving web 21 to the diffuser back section 33. The moving belt 16 is grounded through roll 17 so that the charged web 21 is electrostatically attracted to the belt 16 and held in place thereon. Overlapping web swaths collected on the moving belt 16 and held there by electrostatic forces are formed into a sheet 22 with a thickness controlled by the belt speed. The sheet 22 is compressed between belt 16 and consolidation roll 18 into a structure having sufficient strength to be handled outside the chamber 1 and then collected outside the chamber 1 on a windup roll 23.

The electrostatic charging of the web 21 is a critical step in the process. It accomplishes two important purposes, namely: (1) it prevents a collapse of the web 21 during transport because the charged fibrils repel each other; and (2) it keeps the sheet 22 pinned to the collecting metal belt 16, which is usually at ground potential. Both functions should be properly achieved to result in a non-woven sheet product with the desired uniformity. The preferred level of electrostatic charge is approximately 6 to 10 microcoulombs (μmC) per gram of polymer. The charging system comprises a power supply capable of delivering 1000 μA direct current at 100 kV, a multi-needle ion gun emitting a 200–900 μA corona current, and a rotating target plate. One preferred target plate is a grounded metal ring covered with a carbon-filled elastomeric material. However, other target plates, e.g., a metal disk, may also be used. The spacing of the charging needles of the ion gun 30 and their distance from the target plate 31 is such that all of the web 21 is uniformly charged. If the charging is not uniform, poorly charged sections do not pin to the belt 16, roll up or twist. This results in a product defect in the non-woven sheet material 22. In addition to being uniform, the charge should also generate sufficient repulsion forces between individual fibrils to satisfactorily open up the web 21. The natural tendency is for the web 21 to pull back together as a yarn which would also cause product defects. Thus, it is important to sufficiently charge the web to overcome the natural collapse inducing forces.

In the process as illustrated in FIG. 1, both the target plate 31 and the metal belt 16 are grounded. This is the safest and preferred industrial embodiment; however, electrostatic potentials of opposite polarity may be provided to the target plate 31 and the belt 16 with suitable results. In addition, the ion gun 30 may be provided either a positive potential or a negative potential. Even when the polarities are the same, i.e., both are positive or both are negative, electrostatic charging can still take place if there is a sufficiently large potential difference between the ion gun 30 and the target plate 31. All such alternate embodiments are intended to be within the scope of the present invention.

It should be appreciated that the atmosphere in the flash-spinning, web-forming, and web-collecting area should be created and maintained such that it will inhibit electric discharge or break down at the voltages used in the process.

It is believed that the plexifilament charging process occurs as follows: The gas in the vicinity of sharp needles of the ion gun undergoes what is termed corona breakdown. In a small volume near the needles, the gas is ionized, with both positively charged and negatively charged gas ions being formed. If the ion gun voltage is negative, then negative ions and electrons are drawn out of the corona and migrate towards the target plate. Some of these ions are intercepted by fibrils passing between the needles and the target plate. The percentage of ions intercepted is the efficiency of the charging process. If the polarity is reversed, the positive ions are drawn from the corona to the target plate, in which case the fibrils will charge positively.

Thus, the charged ions collected on the fibrils are what provide the electrostatic charge thereon. The magnitude of the charge is relative to the density of the ions collected on the web 21 which may be measured in microcoulombs per gram (μC/g). The charge applied to the web is most easily determined by determining the difference between the charge delivered by the ion gun 30 and the charge received by the target plate 31. Since the amperages of the ion gun 30 and the target plate 31 are monitored by the microamperemeters 37 and 38, and amperage is simply a measure of charge per second,, the difference between the amperages represents the charge being applied per second to the web 21. This is most simply expressed as $I_w=I_g-I_{tp}$, where $I_w$=web current. Thus, the charge density on the web 21 may be determined by:

$$Q=\frac{I_g-I_{tp}}{W}$$

wherein:

Q=charge density applied to the web, expressed in μC/g;

$I_g$=ion gun current, in microamps (μA);

$I_{tp}$=target plate current, in microamps (μA); and

W=mass of the web, in grams, entering the field per second.

However, as noted above in the background of the invention, the hydrocarbon solvents cause the charge density to be lower than current CFC solvents. The performance differences between the various vapor atmospheres may be compared to one another by comparing the charging efficiency calculated for each. The charging efficiency is calculated as follows:

$$E=\frac{I_g-I_{tp}}{I_g}\times 100\%$$

wherein:

E=charging efficiency;

$I_g$=ion gun current, in microamps (μA); and $I_{tp}$=target plate current, in microamps (μA).

It is believed that as charges are placed on the web 21, a reaction field is generated that repels further placement of charges of the same type that are on the web 21.

It is known by Parthenier's equation (as generally described by Ion I. Inculet in his paper "Particle Charging in DC Corona Fields" IEEE transactions on Electrical Innovations, Vol. E1-17, No. 2, Apr. 1982.) that there is a theoretical maximum amount of charge that may be provided on a material. The rate at which the material is further charged continually decreases as the material continues to accept further charges and approaches the theoretical maximum charge level. The rate at which the charges may be applied and the theoretical maximum charge that can be applied are dependent on the field strength at the object being charged.

In the present invention, it is believed that the composition of the atmosphere effects the relative strength of the applied electric field at the web generated by the high voltage between the ion gun 30 and the target plate 31. Based on theory and experimentation, the relative charging efficiency with various solvent mixtures has been found to be predictable based on measured voltage difference between the ion gun 30 and the target plate 31. Thus a solvent mixture that provides for a voltage difference comparatively larger than another solvent mixture would be expected to have a proportionally higher charging efficiency of a web without having to run a polymer web through the field. Thus, one does not need to run a polymer through a field in order to determine relative charging efficiencies of various solvents.

The hydrocarbon spin liquids useful in the process of the present invention have 4 to 7 carbon atoms and can have any structure, i.e., normal, branched, or cyclic. Typical such hydrocarbons are, butane, isobutane, cyclobutane, 2-methylbutane, pentane, 2-methylpentane, 3-methylpentane, 2,2-dimethylpropane, methylcyclobutane, 2,3-dimethylbutane, hexane, methylcyclopentane, cyclohexane, 2-methylhexane, 3-methylhexane, methylcyclohexane, heptane, and mixtures of two or more such hydrocarbons.

As noted above, the aforementioned hydrocarbon group of solvents tend to reduce the charging efficiency in comparison to conventional CFC solvents. By this invention, it has been discovered that the charging efficiency can be dramatically improved by the addition of one or more charge-improving compounds. However, it has been recognized that as part of the program to find a suitable alternative solvent and develop a process and system adapted to the particular characteristics of the new solvent, Hyunkook Shin, a co-inventor of this present application, developed alternative solvents for mixing with the hydrocarbon solvent to raise the cloud-point pressure of the resulting spin fluid along with another DuPont employee. This work resulted in a patent application being filed which has now been issued as U.S. Pat. No. 5,147,586. In that patent, hydrocarbon spin liquids are set forth which are mixed with a co-solvent spin liquid which raises the cloud-point pressure of the resulting spin mixture by at least 200 psig.

Coincidentally, the aforementioned Shin et al. patent discloses co-solvents which happen to be useful as a charge improving compounds as set forth under the present invention. However, as a co-solvent under the Shin et al. patent, the material must be present in an amount greater than 10 percent by weight. The disclosed co-solvent spin liquids of the Shin et al. patent have atmospheric boiling temperatures of less than 100° C. and are preferably inert gases, hydrofluorocarbons, hydrochlorofluorocarbons, perfluorocarbons, $C_1$–$C_4$ alcohols, aliphatic ketones and polar solvents. These co-solvents generally coincide with the charge-improving compounds listed in the first group of charge-improving compounds. Although the first group of charge-improving compounds are preferably used at much lower concentration and for substantially different purposes than are set forth and claimed in the Shin et al. patent, the concentration of such compounds in the solvent has been disclaimed in this application to avoid any overlap.

The charge-improving compounds which must be present in the charge applying atmosphere have a number of common characteristics, although not necessarily all of the same characteristics. In an electrical field, they are capable of becoming either positively charged or negatively charged (forming cations or anions) and/or of emitting electrons. This ability may be related to the structure of the outer electron shell of one of the atoms which may be present in the molecule. Many atoms (occasionally referred to by organic chemists as hetero atoms) such as halogens, oxygen, sulfur, and nitrogen are particularly susceptible to accepting charges. Organic compounds containing hetero atoms often exhibit polarity and therefore are called polar compounds. When subjected to high DC voltage, even inert gases can undergo ionization. The charge-improving compounds useful in the process of the present invention must be sufficiently stable under the conditions prevailing in the spin cell, so that they will not undergo degradation, which could cause web contamination and/or corrosion of the apparatus. All the spin liquid co-solvents recited in the above U.S. Pat. No. 5,147,586, which form the first group of compounds recited in the Summary of the Invention, would also function as charge-improving compounds.

The charge-improving compound should be a gas or vapor in the spin cell or chamber 1. Preferably, the charge-improving compound would have a low enough boiling point so as not to condense within the chamber 1. However, this may be a function of its concentration in the chamber 1. For example, the very low concentrations that are envisioned under this invention could allow for charge-improving compounds having boiling points as high as 350° to 400° C. in a chamber that is about 50° C. This means that boiling point will be of little relevance for compounds that are effective at very low concentrations.

Through the development effort that has lead to the filing for this patent, a great variety of interesting charge-improving compounds have been identified. For example, water, carbon dioxide and ammonia have been identified as specific compounds that act as charge-improving compounds. Others are more easily enumerated as classes or groups of similar compounds. For example, the following types of compounds are of interest for use in a flash-spinning process:

(1) Hydrofluorocarbons:

Pentafluoroethane; $C_2H_2F_4$, e.g., 1,2,2,2-tetrafluoroethane; $C_2H_4F_2$, e.g., 1,1-difluoroethane; $C_3H_2F_6$, e.g., 1,1,1,3,3,3-hexafluoropropane; $C_4H_2F_8$, e.g., 1,1,2,2,3,3,4,4-octafluorobutane; and $C_5H_2F_{10}$, e.g., 1,1,2,2,3,3,4,5,5,5-decafluoropentane.

(2) Hydrochlorofluorocarbons:

Chlorodifluoromethane; $C_2HCl_2F_3$, e.g., 1,1-dichloro-2,2,2-trifluoroethane; $C_2HClF_4$, e.g., 1-chloro-1,2,2,2-tetrafluoroethane; $C_2H_3Cl_2F$, e.g., 1,1-dichloro-1-fluoroethane; $C_2H_3ClF_2$, e.g., 1-chloro-1,1-difluoroethane; and $C_3HCl_2F_5$, e.g., 1,3-dichloro-1,2,2,3,3-pentafluoropropane.

(3) Perfluorocarbons:

Perfluoromethane, perfluoroethane; perfluropropanes, perfluorobutanes, perfluoropentanes, perfluorohexanes, and perfluoroheptanes, whether linear, branched, cyclic, or alkyl-substituted cyclic including, e.g., perfluorocyclopropane, perfluoropentane, perfluorocyclohexane, perfluorodecalin, and perfluorodimethylcyclobutane.

(4) Hydroxylic compounds (alcohols, glycols and polyols): Methanol, ethanol, propanol, isopropyl alcohol, sec-butyl alcohol, tert-butyl alcohol, n-amyl alcohol, 1-hexanol, and ethylene glycol.

(5) Ketones:

Methyl ethyl ketone, acetone, isopropyl methyl ketone, diacetyl, methyl propyl ketone, 1,1,3-trichloro- 1,3,3-trifluoro acetone, and acetophenone.

(6) Perchlorofluorocarbons:

Trichlorofluoromethane, dichlorodifluoromethane, chlorotrifluoromethane, and 1,1,2,-trichloro- 1,2,2-trifluoroethane.

(7) Perchlorocarbons:

Carbon tetrachloride, perchloroethane.

(8) Organic perfluorosulfides:

Perfluoro(dimethyl sulfide)

(9) Perfluoroamines:

Perfluoro(N-methylmorpholine); perfluoro(N-ethylmorpholine).

(10) Fluoroethers:

1,1,2,3,3,3-Hexafluoropropyl methyl ether, 1,1,2,3,3,3-hexafluoropropyl vinyl ether, perfluoropropyl-1,2,2,2-tetrafluoroethyl ether

(11) Hydrochlorocarbons:

Dichloroethane, 1,2-dichloropropane 1,2-dichloroethylene, and chlorobenzene.

(12) Fluoroalcohols:

Difluoromethanol, 1,2,2-trifluoroethanol, 2,2,3,3,3-pentafluoropropanol.

(13) Esters:

Methyl acetate, ethyl acetate, methyl propionate, methyl butyrate, isopropyl acetate, propyl formate, and dimethyl carbonate.

(14) Ethers:

Dimethyl ether, diethyl ether, ethyl isopropyl ether, dipropyl ether, diisopropyl ether, methyl butyl ether, tetrahydrofuran, tetrahydropyran, and ethylene glycol dimethyl ether.

(15) Nitriles:

Acetonitrile, propionitrile, fluoroacetonitrile.

(16) Amines:

Methylamine, ethylamine, dimethylamine, diethylamine, triethylamine, N-methylpyrrolidone, 1,2-dimethylpyrrolidone, and 1,3-dimethylpyrrolidone.

(17) Halogen gases:

chlorine, bromine, and iodine.

(18) Acid Halides:

hydrogen chloride, hydrogen bromide, hydrogen iodide.

(19) Carboxylic acids:

formic acid, acetic acid, chlorodifluoroacetic acid.

(20) Sulfur Compounds:

sulfur dioxide, carbon disulfide.

(21) Aldehydes: formaldehyde, acetaldehyde.

(22) Nitro comounds:

nitromethane, nitroethane.

(23) Nitrogen oxides:

nitrous oxide.

(24) Amides:

acetamide, N,N-dimethylformamide.

The preferred charge-improving compounds are perfluorocarbons, hydrofluorocarbons, and alcohols.

Since the liquids originally present in the solution, i.e., the solvents and cosolvents, are to a large extent evaporated when exiting the spinneret, it is assumed for the purpose of the present invention that, if no additional gases or vapors are introduced directly into the electrostatic charge environment, the composition of that environment will be approximately the same as that of the liquids in the initial solution.

In the practical operation of the process of the present invention, the charge-improving compound may be part of the spin liquid and can be introduced therein prior to, during, or following polyolefin dissolution. However, the electrostatic charge-improving compound can be added at any stage prior to or during the electrostatic charging step. This can be done, e.g., by introducing the electrostatic charge-improving compound separately into the electrostatic charge environment in the form of gas, vapor, or mist produced by an external source. Since the electrostatic charging step normally is conducted in a closed chamber, it is a simple matter to maintain the desired atmosphere therein.

For reasons of economy as well as of environmental protection, it is desirable to recover most or nearly all the solvent and charge-improving compound supplied to the process. This can be readily accomplished by cooling the vapors to liquefy them, with or without compression. The composition of the condensed liquids is ascertained by well known analytical procedures such as, e.g., gas chromatography and adjusted to the desired mix by adding proper amount of the component found to be deficient. Well over 99% of the starting liquids, can be recovered and then recycled in this way.

It is not considered practical to have more than about 50% of charge-improving compound in the charge applying atmosphere. In fact, when the charge-improving compound has the potential of being environmentally harmful, e.g., a CFC, it is preferred to limit that amount further, especially to at most 30%. Depending on the effectiveness of the charge-improving compound, it is likely that less than ten weight percent (<10%) and perhaps less than one weight percent (<1%) of charge-improving compound will be used in the atmosphere. On the other hand, most charge-improving compounds preferably should be present in an amount of at least 0.1 ppm and are more likely to be present in an amount of at least 10 ppm or more preferably greater than 25 ppm.

This invention is now illustrated by examples of certain representative embodiments thereof, where all parts, proportions, and percentages are by weight unless otherwise indicated. An apparatus of the type illustrated in FIG. 1 was used in all the experiments, except that in this case, the back section of the diffuser was stationary and not integral with the target plate. The apparatus had a capacity of 22.7 kg of polyethylene per hour. Certain apparatus dimensions were as follows: Letdown orifice length. The target plate had a diameter of 22.9 cm. It consisted of an annular metallic base covered with a carbon-filled rubber material on the surface directly opposite the ion gun needles. The ion gun was a 21-needle double-row (100° arc) model, with 11 needles in the first row spaced 10° on a 7.6 cm radius, and 10 needles in the second row spaced 10° on an 8.9 cm radius. The needles of the ion gun were connected directly to a common, direct current, 60 kV capacity source. The charge was negative, except as stated. The outer row of needles was located opposite the target plate, 2.54 cm from the outer edge. The inner row of needles was similarly located 2.54 cm from the inner edge of the target plate. The needle points were 1.91 cm from the target plate surface.

Web charge was determined as described in the examples.

All determinations of weight and measure not originally made in SI units have been converted to SI units.

EXAMPLE 1

A plexifilament of polyethylene was flash-spun from a solution consisting of 20.0% of linear polyethylene having an initial melt index of 0.7 dg/min, 76% of n-pentane, and 4% of perfluorodimethylcyclobutane. The solution was heated to 175° C. in an autoclave with continuous stirring and at an autogenous pressure of 17237 kPa. Under these conditions of temperature and pressure, a single phase solution was formed in the autoclave. The solution was then forced from the autoclave through a letdown chamber to a single spinneret by feeding pressurized nitrogen to the autoclave. The solution was delivered to the spinneret at 175° C. and flash-spun into a plexifilament at a rate equivalent to 23.4 kg/hour of polymer. This plexifilament was spread and directed downward into a vertical path by passage over a rotary baffle. At the same time, the plexifilament was spread into a wide web, which advanced past an annular target plate of an outer diameter of 22.9 cm and an inner diameter of 10.2 cm. The web was directed onto a continuously moving collecting belt of 11.85 g/m$^2$ REMAY® spunbonded polyester over a grounded, perforated metal support surface traveling at 27.4 m/min.

During its travel, the spread web 21 was exposed to the ionized atmosphere between the negative polarity ion gun and the rotating annular target plate and collected a negative charge. The metallic base of the target plate was grounded. The pressure in the letdown chamber was varied from 9653 to 13790 kPa by feeding nitrogen to the autoclave through a control valve.

Before the spinning operation, the concentration of the gas inside the closed chamber surrounding the spinneret was adjusted to approximately the same composition as in the spin liquid, as determined by gas chromatography.

Figure 3:
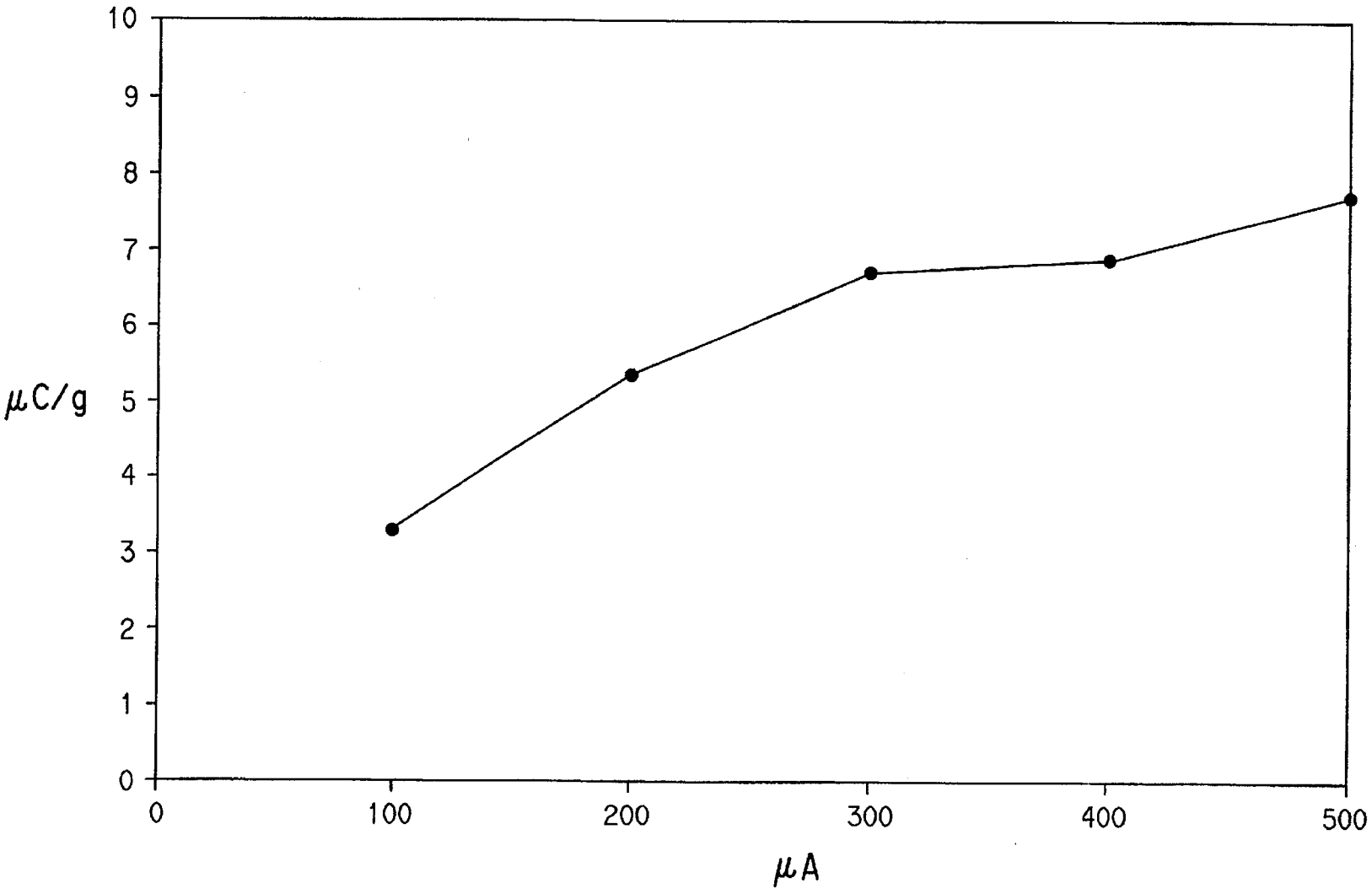
FIG. 3 is a plot of ion gun current vs. electrostatic charge of a polyolefin web as described for Example 1.
Figure 4:
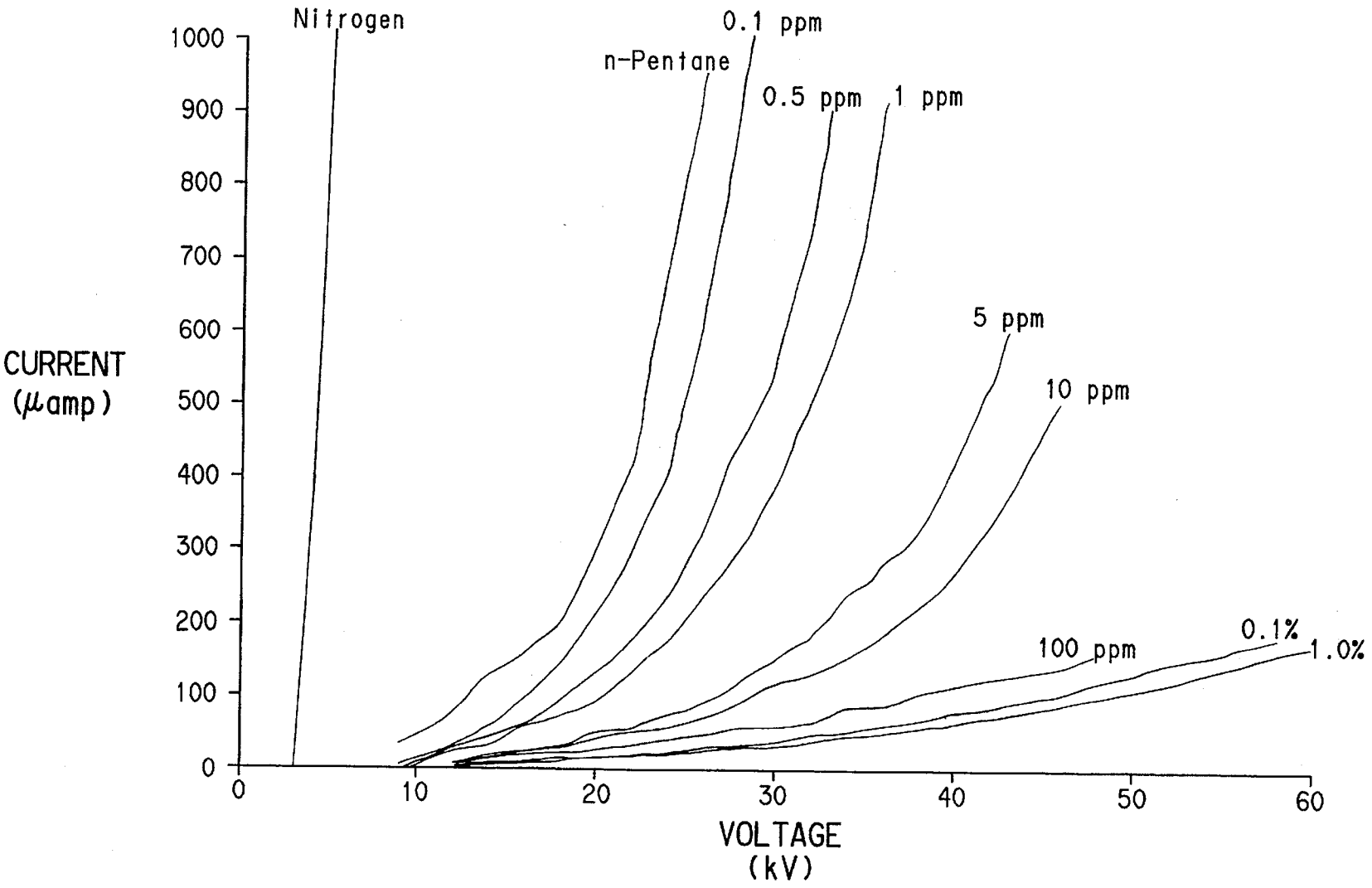
FIG. 4 is a chart indicating the voltage vs. current for various concentrations of trichlorofluoromethane, which is sold by DuPont under the trademark FREON® 11 trichlorofloromethane, in n-pentane solvent.
Figure 5:
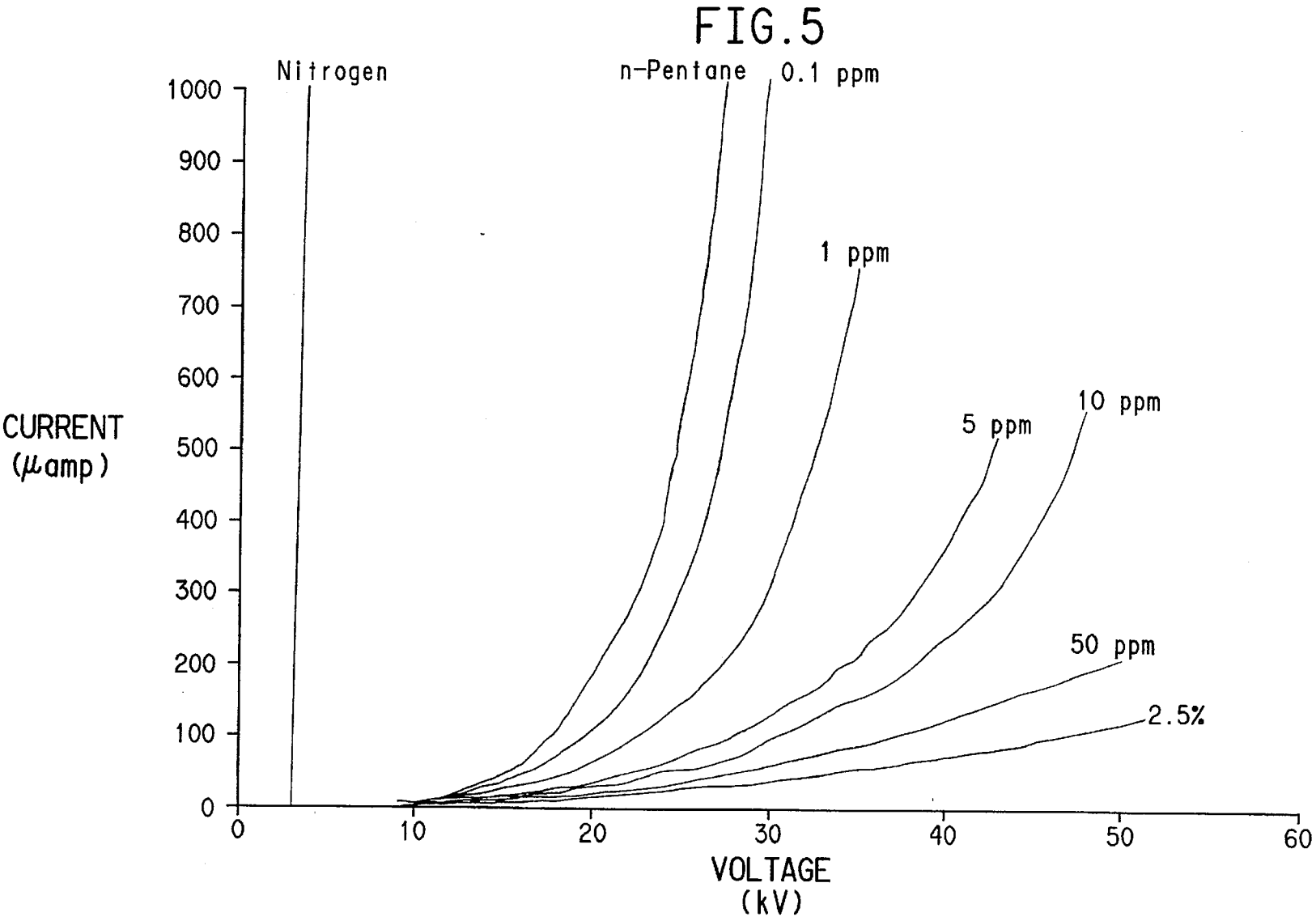
FIG. 5 is a chart indicating the voltage vs. current for various concentrations of perfluoro(dimethylcyclobutane), which is sold by DuPont under the trademark VERTREL® 245 perfluoro(dimethylcyclobutane), in n-pentane solvent.
Figure 6:
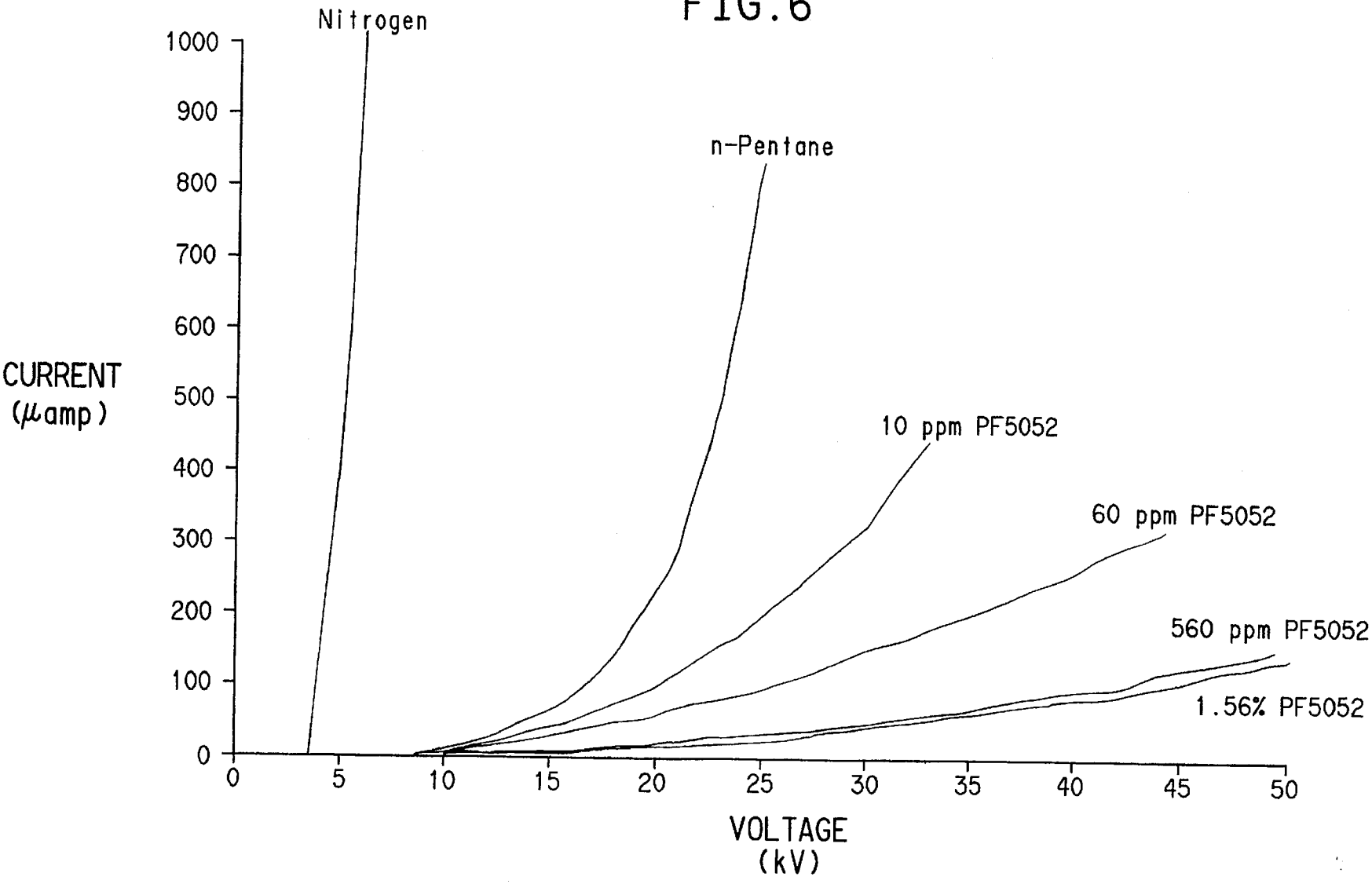
FIG. 6 is a chart indicating the voltage vs. current for various concentrations of perfluoro(N-methylmorpholine), which is sold by 3M Company as PF 5052, in n-pentane solvent.
Figure 7:
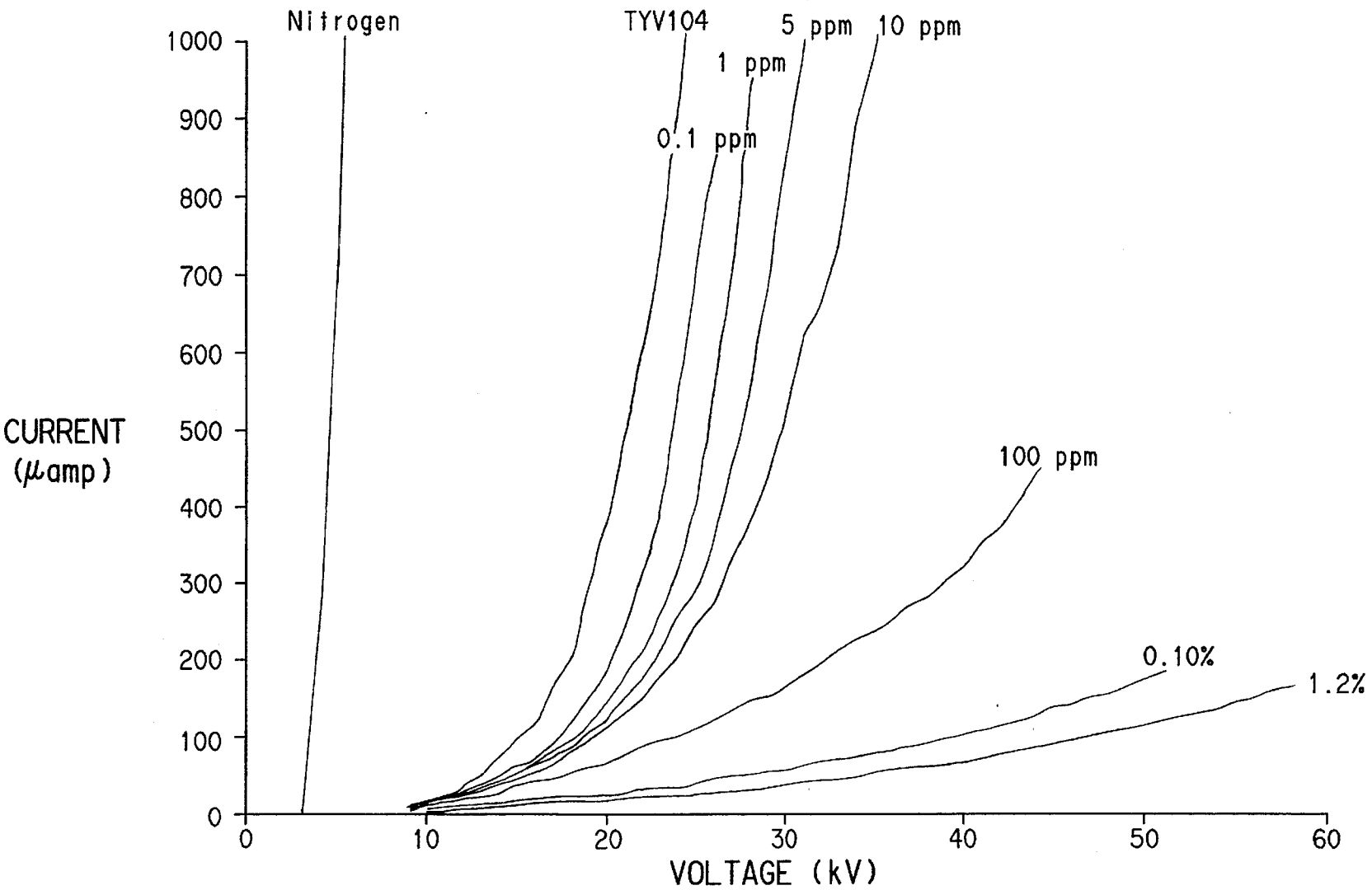
FIG. 7 is a chart indicating the voltage vs. current for various concentrations of 1,2,2,2-tetrafluoroethyl pentafluoropropyl ether in n-pentane solvent.
Figure 8:
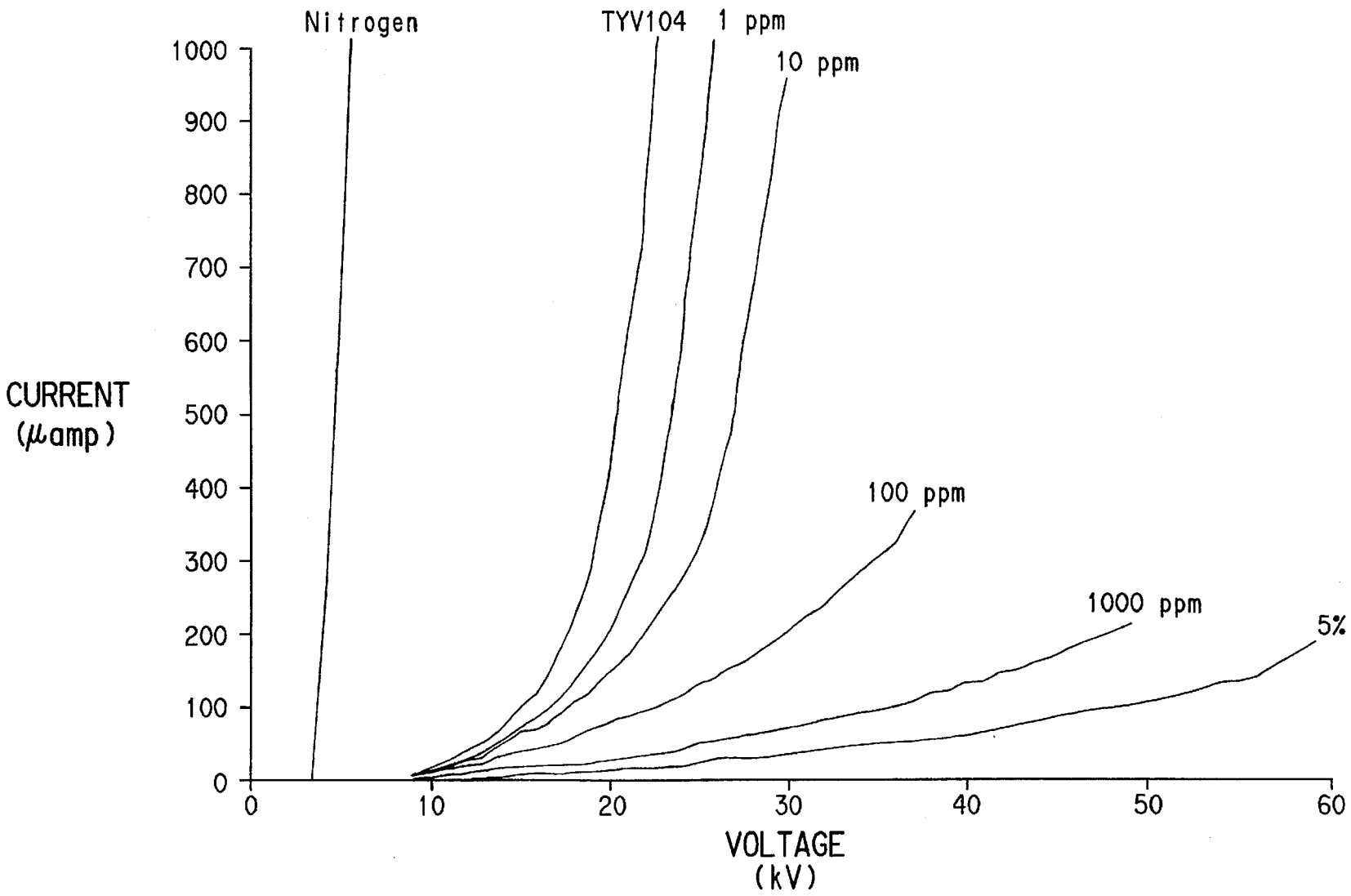
FIG. 8 is a chart indicating the voltage vs. current for various concentrations of 2,3-dihydrodecafluoropentane, which is also referred to as HFC-4310mee, in n-pentane solvent.
Figure 9:
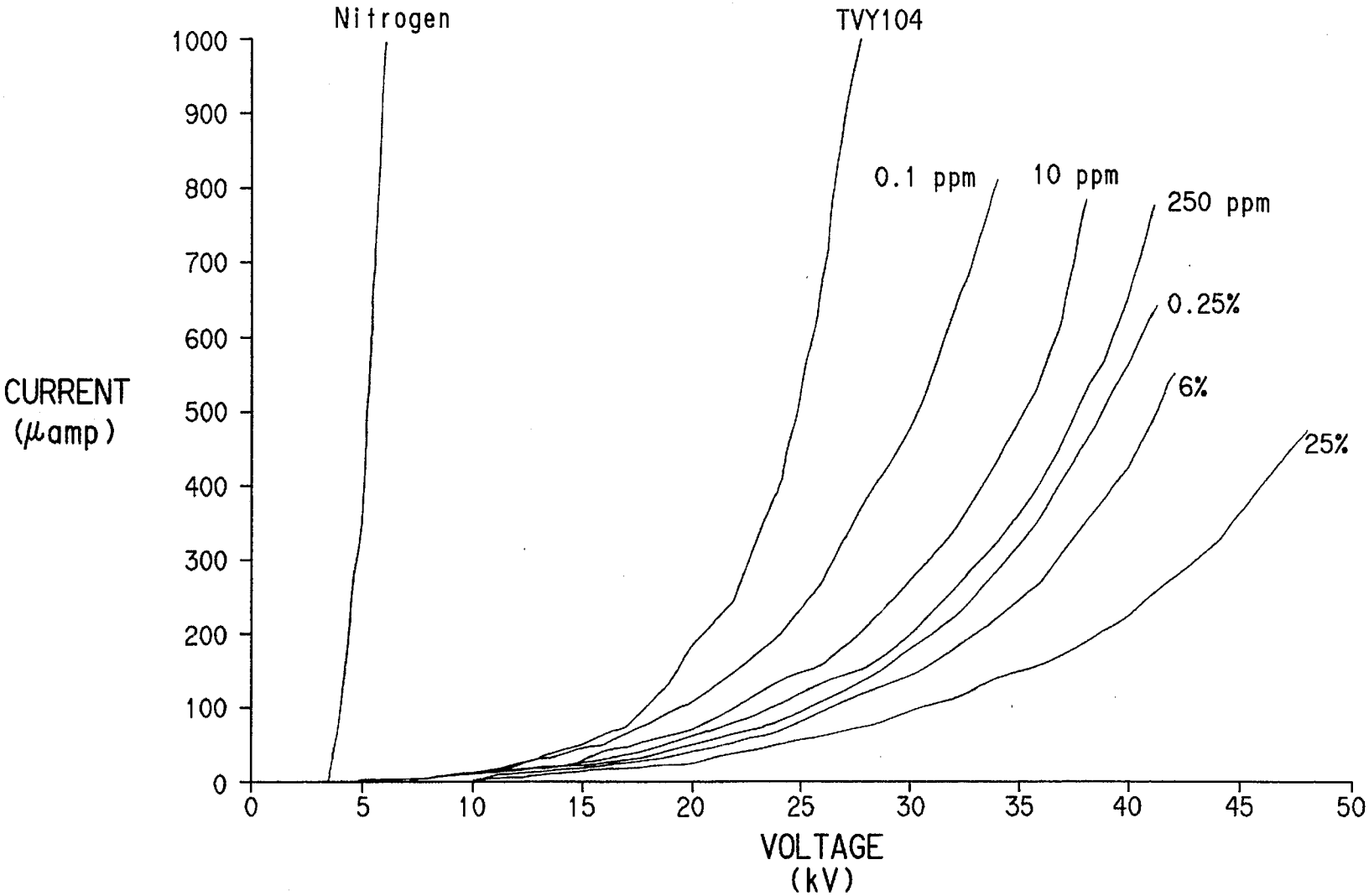
FIG. 9 is a chart indicating the voltage vs. current for various concentrations of isopropanol in n-pentane solvent.
Figure 10:
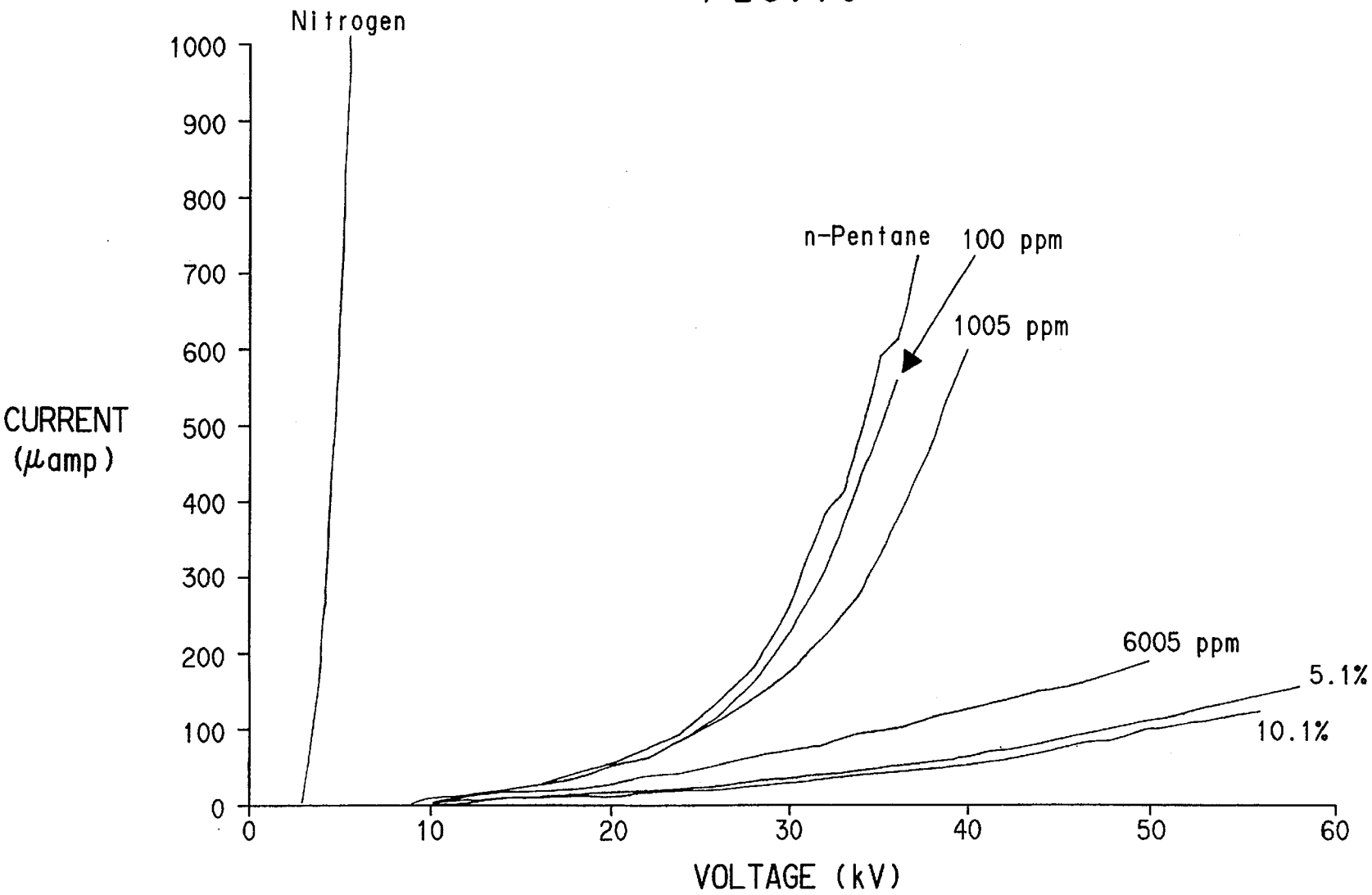
FIG. 10 is a chart indicating the voltage vs. current for various concentrations of 2,2,3,3,3-pentafluoropropanol, which is sold by Daikin Industries of Japan under the trademark PEFOL® 5P pentafluoropropanol, in n-pentane solvent.

The charge on the fibers was calculated from the polymer flow rate and the difference between the current flowing from the ion gun 30 as measured by the ion gun current microamperemeter 37 and that collected by the target plate 31 as measured by target plate current microamperemeter 38 in accordance with the following equation: $Q=(I_g-I_{tp})/W$ which has been described above. The web charge at an ion gun current of 300 μA varied with the letdown pressure and had a maximum value of 8.5 μC/g at 12755 kPa. letdown pressure. Optimum fiber formation, as judged by observing the web between the spinneret and the belt through a sight glass, was achieved at a letdown pressure of 11721 kPa, where the web charge was 6.8 μC/g. When letdown pressure was held constant at 11721 kPa, and ion gun current was varied from 100 to 500 μA, web charge increased from 3.2 at 100 μA ion gun current to 7.7 μC/g at 500 μA ion gun current. This is shown in FIG. 3, which is a plot of web charge, in μC/g, vs. ion gun current, in μA.

It should be noted here that in order to provide meaningful comparisons of the results from one run to another, the maximum charges at a constant current, rather than the charges for optimum fiber formation are reported in Table 1 below. Although the web charge under the conditions of optimum fiber formation is less than maximum, the higher the maximum charge the higher also is the charge at optimum fiber formation. One skilled in the art can readily determine the letdown pressure and the resulting charge for optimum fiber formation.

EXAMPLE 2

The same procedure as in Example 1 was followed, except that the ion gun needles were connected to a common, positive power source, thereby causing the web to become positively charged. At an ion gun current of 300 μA, the maximum value of web charge of 6.5 μC/g was obtained at a letdown pressure of 13100 kPa.

EXAMPLES 3–6

The polyolefin starting material was a 20% solution of the same polyethylene in n-pentane, with or without a charge-improving compound (sometimes abbreviated below to C-IC). The ion gun needles were negatively charged.

The experimental details and results of Examples 1–6 are summarized in the Table 1 below.

TABLE 1

| Ex. No. | Charge-IC (%)* | LDP (kPa) | Web charge (μC/g) |
|---|---|---|---|
| 1 | A(5%) | 12755 | 8.5 |
| 2 | A(5%) | 13100 | 6.5 |
| 3 | None | 10514 | 6.0 |
| 4 | B(5%) | 10687 | 8.6 |
| 5 | C(6%) | 10859 | 6.7 |
| 6 | C(20%) | 11790 | 8.0 |

wherein:
A = perfluorodimethylcyclobutane, VERTREL ® 245, DuPont
B = trichlorofluoromethane
C = isopropyl alcohol
*Percentage based on total weight of n-pentane plus Charge-IC

EXAMPLE 7

In this example, the polyolefin solution had the same composition as in Example 3; i.e., no charge-improving compound was present in the solution. Prior to spinning, the composition of gas atmosphere in the spin cell was adjusted to 65.8% of n-pentane, 26.5% of trichlorofluoromethane, and 7.7% nitrogen, as determined by gas chromatography. During spinning, at an ion gun current of 290 μA, a maximum value of web charge of 7.5 μC/g was obtained at a letdown pressure of 10550 kPa.

The above Examples 1–7 show that in the presence of a charge-improving compound significant improvement of charging efficiency can be obtained. In the presence of perfluorodimethylcyclobutane, a 41.6% increase in charge on the web was noted with negative charge (Example 1). The improvement value with positive charge (Example 2) cannot be provided because a control experiment with positive charge under the same conditions was not run. However, preliminary experiments with a pentane solution of polyethylene in the absence of a charge-improving compound indicate that the charge level would be very low, probably no more than about 3 μC/g. In the presence of trichlorofluoromethane added to the spin solution (Example 4), a 43.3% increase in charge on the web was obtained. When the same charge-improving compound was introduced directly into the spin cell (Example 7), a 25% increase in charge on the web was observed at a slightly lower ion gun current. In the presence of isopropyl alcohol at 6% concentration (Example 5), only an 11.6% increase in charge on the web was noted, while at a 20% concentration (Example 6), a 33.3% increase in charge on the web was obtained.

It is recognized that the conditions of Example 6 would inherently fall within the scope of the process of U.S. Pat. No. 5,147,586. Generally speaking, when the spin liquid cosolvents of that patent are present in amounts of more than 10 weight percent, as required by the patent, electrostatic charge efficiency will be inherently satisfactory. The present invention shows that the same liquids can improve electrostatic charge efficiency at lower concentrations, and that many other compounds will improve electrostatic charge efficiency as long as they are present in the spin cell environment, irrespective of the method by which they are introduced therein.

EXAMPLE 8

The starting solution contained 18% polyethylene with 82% n-pentane prepared in a continuous mixing unit and delivered at a temperature of 175 ° C., pressure of 2500psi, and flow rate of 22.7 kg/hr through a heated transfer line to spin packs essentially equivalent to those used in Example 1 with the exception that the rubber-covered target plates were replaced with solid metal target plates of the same dimensions. Four spin packs were operated during this example. Letdown pressure was 1600 psi and web charge was maintained at 9.6 μC/g. The charging efficiency and ion-gun current are presented in Table 2 below.

EXAMPLE 9

After stable spinning conditions had been established in the system of Example 8, a trichlorofluoromethane charge-improving compound was added to the n-pentane, changing the spinning solvent to a 6.1% trichlorofluoromethane/93.9% n-pentane mixture and the spinning solution to 18% polyethylene/77% n-pentane/5% trichlorofluoromethane. The web charge was maintained at 9.6 μC/g and the charging efficiency and ion-gun current are presented in Table 2 below.

EXAMPLE 10

The system of Examples 8 and 9 was shut down and the concentration of trichlorofluoromethane was diluted to a concentration of 5 ppm as measured by gas chromatography. The system was restarted with six spin packs essentially equivalent to the packs used in Examples 8 and 9. Web charge was established and maintained at 8.2 μC/g and the charge efficiency and ion-gun current are presented in the following Table 2.

TABLE 2

| Ex. No. | Charge-IC* | Charge Eff.(%) | Ion-Gun Current (μ/A) |
|---|---|---|---|
| 8 | None | 12.3 | 510 |
| 9 | B(6%) | 24.4 | 250 |
| 10 | B(5ppm) | 18.9 | 270 |

wherein: B = trichlorofluoromethane
*Concentration based on total weight of n-pentane plus charge-improving compound.

Referring now to FIGS. 4 through 10, tests on a variety of promising charge-improving compounds have provided evidence of the dramatic improvement of the field strength and thus the charging efficiency of small amounts of such charge-improving compounds. The tests were conducted using laboratory scale equipment that can control or create precise atmospheric compositions for testing and be purged between tests. The equipment includes a single stainless steel needle spaced 1.9 centimeters from a stainless steel metal target plate of approximately 7.6 centimeters in diameter. The needle was connected to a negative polarity output. The results, of the tests are abbreviated and summarized in Table 3 below:

TABLE 3

| | Voltage Increase Factor (n-Pentane = 1.0) | | | |
|---|---|---|---|---|
| Charge-IC | 10 ppm | 50 ppm | 100 ppm | 1000 ppm |
| Freon ® 11 trichlorofluoromethane | 2.1 | 2.5 | 2.75 | 3.4 |
| Vertrel ® 245 perfluoro-(dimethyl-cyclobutane) | 1.7 | 1.9 | 2.1 | 2.3 |
| PF 5052 | 1.2 | 1.4 | 1.7 | 2.3 |

TABLE 3-continued

| | Voltage Increase Factor (n-Pentane = 1.0) | | | |
|---|---|---|---|---|
| Charge-IC | 10 ppm | 50 ppm | 100 ppm | 1000 ppm |
| Freon ® E1 trichlorofluoromethane | 1.2 | 1.3 | 1.5 | 2.8 |
| HFC 4310 | 1.1 | 1.3 | 1.5 | 2.7 |
| Isopropanol | 1.2 | 1.2 | 1.3 | 1.5 |
| Pefol ® 5P pentafluoropropanol | 1.0 | 1.0 | 1.0 | 1.6 |
| n-Pentane | 1.0 | 1.0 | 1.0 | 1.0 |

Clearly, from the chart above, it should be recognized that the charging efficiency may be improved by a rather small amount of a charge-improving compound. During the development of this invention, it had to be learned and appreciated just how many compounds are effective to improve the charging efficiency and just how low the concentration of charge-improving compounds may be effective. However, some compounds must be at a higher concentration than others to be satisfactorily effective. As such, an improvement in the charging efficiency of 10% over the charging efficiency without the charge-improving compound is believed to fairly represent an effective improvement. However, it should be understood that the 10% improvement is compared when maintaining the web current constant. In other words, it is feasible for purposes of study, to compare the charging efficiencies from before and after introduction of a charge-improving comound using the same ion-gun current $I_g$. Thus the only number that changes for determining the relative efficiencies is the target plate current $I_{tp}$. In practice, however, the ion gun current $I_g$ is adjusted to maintain the web current ($I_g$–$I_{tp}$) constant. Ultimately, it is the purpose of the system to adequately charge the web 21 to maintain it open and pin the sheet 22 being formed therefrom to the belt 16. Thus, both the ion gun current $I_g$ and the target plate current will be adjusted until their difference is resolved to be the same as it was without the charge-improving compound. At this point, the charging efficiency with the added charge-improving compound may be determined.

As a concept of percentage improvement may be confusing, what is intended by a 10% improvement is a percentage of a percentage wherein the web charge is maintained constant and not an additional 10% to the charging efficiency. For example, a 10% improvement is intended to mean an improvement from 25% to 27.5% and not an improvement from 25% to 35%.

The foregoing description is intended solely to provide a clear explanation of the invention and is not intended to limit the scope of protection provided by the claims that follow.

We claim:

1. In the process for flash-spinning plexifilamentary film-fibril strands of a fiber-forming crystalline polyolefin at a temperature of 130° C. to 300° C. and at a mixing pressure greater than autogenous pressure from a solution consisting essentially of 8 to 35 weight percent of the polyolefin and 92 to 65 weight percent of a spin liquid comprising at least one saturated $C_4$–$C_7$ hydrocarbon, electrostatically charging the strands, and laying the strands as a sheet on a continuously moving surface;

wherein the improvement comprises conducting the electrostatic charging step in an atmosphere comprising at least one charge-improving compound, such that said charge-improving compound belongs to one of groups A and B, wherein group A comprises compounds that have an atmospheric boiling temperature of less than 100° C. and consists of one of carbon dioxide, hydrofluorocarbons, hydrochlorofluorocarbons, perfluorocarbons, alcohols, aliphatic ketones, and polar solvents; and wherein group B consists of compounds not listed in group A that are within the following categories of compounds: compounds of the types listed in group A except having atmospheric boiling temperatures of at least 100° C.; halogen gases; acid halides; halocarbons, except fully halogenated chlorofluorocarbons, that are not listed in group A; hydroxylic compounds, ethers, carboxylic acids; esters; sulfur compounds; non-aliphatic ketones; aldehydes; nitro compounds; nitrogen oxides; nitriles; ammonia; amines; amides; and halogenated derivatives of the above compounds which do not already contain a halogen atom;

such that the atmosphere comprises at least 0.1 ppm of charge-improving compounds, up to ten weight percent of group A charge-improving compounds, and less than seventy-five weight percent of group B charge improving compounds.

2. The process according to claim 1 wherein said atmosphere comprises at least one group A charge-improving compound.

3. The process according to claim 1 wherein said atmosphere comprises at least one group B charge-improving compound.

4. The process according to claim 1 wherein said at least one charge-improving compound is a component of the spin liquid.

5. In the process for flash-spinning plexifilamentary film-fibril strands of a fiber-forming crystalline polyolefin at a temperature of 130° C. to 300° C. and at a mixing pressure greater than autogenous pressure from a solution consisting essentially of 8 to 35 weight percent of the polyolefin and 92 to 65 weight percent of a spin liquid comprising at least one saturated $C_4$–$C_7$ hydrocarbon, electrostatically charging the strands, and laying the strands as a sheet on a continuously moving surface;

wherein the improvement comprises conducting the electrostatic charging step in an atmosphere comprising at least one charge-improving compound, predominantly in gas of vapor form, such that said charge-improving compound belongs to one of groups A and B, wherein group A comprises compounds that have an atmospheric boiling temperature of less than 100° C. and consists of one of carbon dioxide, hydrofluorocarbons, hydrochlorofluorocarbons, perfluorocarbons, alcohols, aliphatic ketones, and polar solvents; and wherein group B consists of compounds not listed in group A that are within the following categories of compounds; compounds of the types listed in group A except having atmospheric boiling temperatures of at least 100° C.; halogen gases; acid halides; halocarbons that are not listed in group A; hydroxylic compounds, ethers, carboxylic acids; esters; sulfur compounds; non-aliphatic ketones; aldehydes; nitro compounds; nitrogen oxides; nitriles; ammonia; amines; amides; and halogenated derivatives of the above compounds which do not already contain a halogen atom;

wherein said at least one charge-improving compound is introduced directly, as a gas, vapor, or mist, into the electrostatic charging atmosphere.

6. The process according to claim 1 where said at least one charge-improving compound has an atmospheric boiling temperature in the range of 0° C. to 150° C.

7. The process according to claim 6 where said at least one charge-improving compound has an atmospheric boiling temperature in the range of 20° C. to 90° C.

8. The process according to claim 1 wherein said at least one charge-improving compound is a halogenated compound.

9. The process according to claim 8 wherein said at least one charge-improving compound is a halogenated organic compound.

10. The process according to claim 9 wherein said at least one charge-improving compound is a hydrochlorofluorocarbon.

11. The process according to claim 9 wherein said at least one charge-improving compound is a hydrofluorocarbon.

12. The process according to claim 8 wherein said halogenated charge-improving compound includes at least one chlorine atom.

13. The process according to claim 8 wherein said halogenated charge-improving compound includes at least one fluorine atom.

14. The process according to claim 8 wherein said halogenated charge-improving compound includes at least one bromine atom.

15. The process according to claim 8 wherein said halogenated charge-improving compound includes at least one iodine atom.

16. The process according to claim 1 wherein the atmosphere comprises from 10 ppm to 10 weight percent of charge-improving compounds.

17. The process according to claim 16 where the atmosphere comprises from 25 ppm to 1.0 weight percent of charge-improving compounds.

18. The process according to claim 8 wherein said halogenated charge-improving compound is a halogenated non-organic compound.

19. The process according to claim 8 wherein said halogenated charge-improving compound is a halogenated hydroxylic compound.

20. The process according to claim 8 wherein said halogenated charge-improving compound is a halogenated ether.

21. The process according to claim 8 wherein said halogenated charge-improving compound is a halogenated carboxylic acid.

22. The process according to claim 8 wherein said halogenated charge-improving compound is a halogenated ester.

23. The process according to claim 8 wherein said halogenated charge-improving compound is a halogenated ketone.

24. The process according to claim 8 wherein said halogenated charge-improving compound is a halogenated amine.

25. The process according to claim 8 wherein said halogenated charge-improving compound is a halogenated aldehyde.

26. The process according to claim 8 wherein said halogenated charge-improving compound is a halogenated sulfur compound.

27. The process according to claim 1 wherein said at least one charge-improving compound is carbon dioxide.

28. The process according to claim 1 wherein said at least one charge improving compound is perfluoro(n-methylmorpholine).

29. The process according to claim 1 wherein said at least one charge-improving compound is a non-halogenated compound.

30. The process according to claim 29 wherein said at least one charge-improving compound has an atmospheric boiling temperature of less than 100° C. and is selected from the group consisting of alcohols, ketones, esters, ethers, and carboxylic acids.

31. The process according to claim 29 wherein said at least one charge-improving compound is a sulfur compound.

32. The process according to claim 8 wherein said halogenated charge-improving compound is a fully halogenated compound.

33. The process according to claim 32 wherein said fully halogenated charge-improving compound includes at least one fluorine atom.

34. The process according to claim 33 wherein said charge-improving compound is a fully fluorinated organic compound.

35. The process according to claim 34 wherein said charge-improving compound is a fully fluorinated hydrocarbon.

36. The process according to claim 1 wherein said at least one charge-improving compound is water.

37. In the process for flash-spinning plexifilamentary film-fibril strands of a fiber-forming crystalline polyolefin at a temperature of 130° C. to 300° C. and at a mixing pressure greater than autogenous pressure from a solution consisting essentially of 8 to 35 weight percent of the polyolefin and 92 to 65 weight percent of a spin liquid comprising at least one saturated $C_4$–$C_7$ hydrocarbon, electrostatically charging the strands, and laying the strands as a sheet on a continuously moving surface;

wherein the improvement comprises providing an effective amount of at least one charge-improving compound into the atmosphere in which the strands are electrostatically charged to obtain a ten percent improvement of the charging efficiency for a constant web charge, the charging efficiency is calculated by the following formula, $$E = \frac{I_g - I_{tp}}{I_g} \times 100\%$$

such that:

E=charging efficiency;

$I_g$=ion gun current; and $I_{tp}$=target plate current;

and wherein the charge-improving compound belongs to one of groups A and B, wherein:

group A comprises compounds that have an atmospheric boiling temperature of less than 100° C. and consists of one of carbon dioxide, hydrofluorocarbons, hydrochlorofluorocarbons, perfluorocarbons, alcohols, aliphatic ketones, and polar solvents; and group B consists of compounds not listed in group A that are within the following categories of compounds: compounds of the types listed in group A except having atmospheric boiling temperatures of at least 100° C.; halogen gases; acid halides; halocarbons, except fully halogenated chlorofluorocarbons, that are not listed in group A; hydroxylic compounds, ethers, carboxylic acids; esters; sulfur compounds; non-aliphatic ketones; aldehydes; nitro compounds; nitrogen oxides; nitriles; ammonia; amines; amides; and halogenated derivatives of the above compounds which do not already contain a halogen atom;

such that the atmosphere comprises up to ten weight percent of group A charge-improving compounds, and less than seventy-five weight percent of group B charge improving compounds.

38. The process according to claim 37 wherein an effective amount of charge-improving compounds provides at least a 25 percent improvement of charging efficiency.

39. The process according to claim 38 wherein an effective amount of charge-improving compounds provides at least a 60 percent improvement of charging efficiency.

40. The process according to claim 39 wherein an effective amount of charge-improving compounds provides at least a 100 percent improvement of charging efficiency.

* * * * *